US006499635B1

(12) United States Patent
Weinstein

(10) Patent No.: US 6,499,635 B1
(45) Date of Patent: Dec. 31, 2002

(54) GARMENT HANGER

(75) Inventor: Sid Weinstein, New York, NY (US)

(73) Assignee: A.L.T. Sportswear, New York, NY (US)

( * ) Notice: Subject to any disclaimer, the term of this patent is extended or adjusted under 35 U.S.C. 154(b) by 0 days.

(21) Appl. No.: 09/924,257

(22) Filed: Aug. 7, 2001

(51) Int. Cl.[7] ..... A47G 25/14
(52) U.S. Cl. ..... 223/93; 223/85
(58) Field of Search ..... 223/89, 94, 87, 223/93, 85, 91; 24/625

(56) References Cited

U.S. PATENT DOCUMENTS

| | | | | |
|---|---|---|---|---|
| 1,817,621 A | | 8/1931 | Harding | |
| 2,094,355 A | | 9/1937 | Hadjoson | |
| 2,149,674 A | | 3/1939 | Hendrix | |
| 2,153,905 A | | 4/1939 | Yankovitch | |
| 2,499,536 A | | 3/1950 | Stanton | |
| 2,920,800 A | | 1/1960 | Kassardjian | |
| 3,042,275 A | | 7/1962 | Wendorf | |
| 3,049,272 A | | 8/1962 | Tufts | |
| 3,151,788 A | | 10/1964 | Wingate | |
| 3,210,820 A | * | 10/1965 | Humiston | 24/625 |
| 3,343,733 A | | 9/1967 | Schmednecht | |
| 3,348,745 A | | 10/1967 | Basile et al. | |
| 3,980,228 A | | 9/1976 | Bisk | |
| 4,046,293 A | | 9/1977 | Garrison | |
| 5,501,378 A | * | 3/1996 | Kolton et al. | 223/87 |
| 5,620,118 A | * | 4/1997 | Kolton et al. | 223/85 |
| 5,857,597 A | * | 1/1999 | Kolton | 223/85 |

* cited by examiner

*Primary Examiner*—Bibhu Mohanty
(74) *Attorney, Agent, or Firm*—Cooper & Dunham LLP

(57) ABSTRACT

A garment hanger having a connecting element consisting of a protrusion on one hanger arm which fits snugly into a receiving hole on a second hanger arm so that the hanger can be opened and locked closed to receive and secure a garment.

7 Claims, 1 Drawing Sheet

GARMENT HANGER

FIELD OF THE INVENTION

This invention relates to a garment hanger, and more particularly, to a garment hanger having a connecting element so that the hanger may be opened and closed at one end to receive and secure a garment.

BACKGROUND OF THE INVENTION

Various types of garment hangers which can be opened and closed are known. For example, U.S. Pat. No. 1,817,621 to Harding shows a rod which fits into a circular notch in a corresponding arm and is pulled down into a locking position. U.S. Pat. No. 3,343,733 to Schmednecht shows a dowel-like projection on a hanger arm which can be fastened into a groove on a hanger rod to lock the device. Other patents, such as U.S. Pat. No. 3,042,275 to Wendorf and U.S. Pat. No. 3,980,228 to Bisk show more complicated devices for locking hanger arms.

Other hangers known in the art which accommodate folded garments are designed to grab a garment with clasps that lock onto to the ends of a garment, causing unwanted wrinkles and crimping of the garment. Further, the known hangers are too large to hang smaller sized garments, such as baby clothes and the like and are made from heavy materials such as wood and metal.

None of the known devices provide a smaller sized garment hanger made from lightweight material and having a simple connecting element which can be locked into place by pushing a protrusion on one arm through a receiving hole on another arm for a tight fit.

SUMMARY OF THE INVENTION

It is therefore an object of the present invention to provide a garment hanger which can be opened and locked closed by means of a connecting element consisting of a protrusion on one hanger arm which fits snugly into a receiving hole on a second hanger arm.

It is a further object of the present invention to provide a garment hanger which is lightweight and small enough to accommodate smaller garments.

The foregoing object is achieved and the disadvantages of the known garment hanger designs are overcome by providing a garment hanger in accordance with the present invention. The garment hanger includes a neck portion; a suspension element extending upwardly from the neck portion; a top arm molded to the underside of the neck portion; a bottom arm molded to one end of the top arm and connectable to a second end of the top arm; and a connecting element consisting of a protrusion molded to and extending perpendicularly from the second end of the top arm, and a hole positioned on the bottom arm for receiving and securing the protrusion.

The protrusion is formed from two symmetrical half portions, each half portion including a top portion and a base portion, wherein the top portion has a larger diameter than the base portion. The two symmetrical half portions can be angled apart from or aligned parallel to each other. The protrusion can also be formed from a single piece instead of from two symmetrical half portions.

The hanger can be made from bendable plastic, such as polypropylene, polystyrene, resin or the like. The neck portion has an area of at least 0.5 inches squared so that it can accommodate a sticker, indicating, for example, the size or brand of a garment on the hanger. The top and bottom arms of the hanger can be between 4 and 10 inches long, depending on the size of garments to be placed on the hanger.

BRIEF DESCRIPTION OF THE DRAWINGS

The features and advantages of the invention will become apparent upon review of the following detailed description of the preferred embodiment, taken in conjunction with the following drawings, in which.

DETAILED DESCRIPTION

Figure 1:
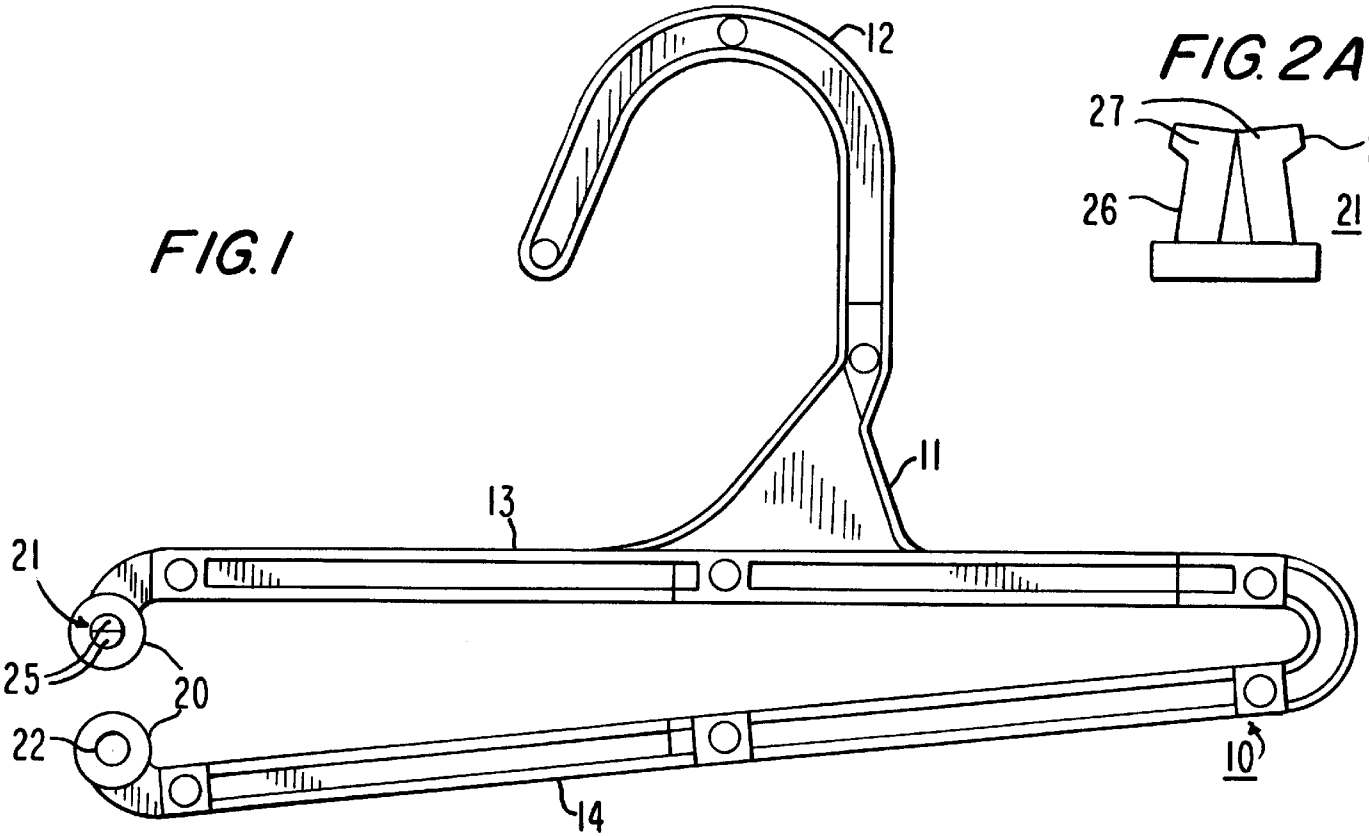
FIG. 1 is a front view of a garment hanger according to the preferred embodiment of the present invention.

As shown in FIG. 1, the present invention relates to a garment hanger 10 including a neck portion 11, a suspension element 12 extending upwardly from the neck portion 11, a top arm 13 molded to the underside of the neck portion 11, a bottom arm 14 molded to one end of the top arm 13 and connectable to a second end of the top arm 13, and a connecting element 20, consisting of a protrusion 21 molded to and extending perpendicularly from the second end of the top arm 13 and a hole 22 positioned on the bottom arm 14 for receiving and securing the protrusion 21.

Figure 2A:
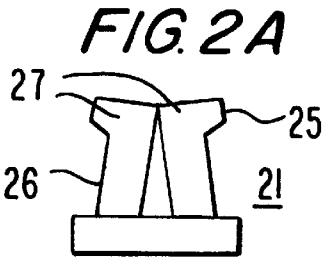
FIG. 2A is a side view of the protrusion according to one embodiment of the present invention.
Figure 2B:
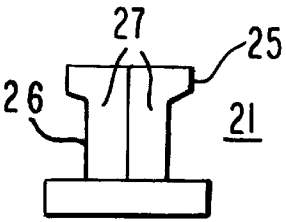
FIG. 2B is a side view of the protrusion according to another embodiment of the present invention.

As shown in FIGS. 2A and 2B, the protrusion 21 is formed from two symmetrical half portions 27, each half portion 27 including a top portion 25 and a base portion 26, the top portion 25 having a larger diameter than the base portion 26. The two symmetrical half portions 27 can be angled apart from or aligned parallel to each other as shown in FIGS. 2A and 2B, respectively.

The hanger 10 can be made from bendable plastic, such as polypropylene, polystyrene, resin or the like. The neck portion 11 has an area of at least 0.5 inches squared so that it can accommodate a sticker, indicating, for example, the size or brand of a garment on the hanger. The top arm 13 and the bottom arm 14 can be between four and ten inches in length. The opening between the top arm 13 and bottom arm 14, in a preferred embodiment, is between 0.25 inches and 0.5 inches.

When the hanger 10 is in the open position, as shown in FIG. 1, a garment can be slid onto the bottom arm 14. A user can then close the hanger 10 by pushing the protrusion 21 through the hole 22. The hole 22 is small enough in diameter to allow the protrusion 21 to fit snugly in the hole 22 and remain in the locked position. A user can return the hanger 10 to the open position by pulling the top arm 13 and the bottom arm 14 apart so that the protrusion 21 is removed from the hole 22.

The preferred embodiment described above is illustrative of the invention, which is not limited to the embodiment described. Various changes and modifications may be made in the invention by one skilled in the art without departing from the spirit or scope of the invention.

What is claimed is:

1. A garment hanger comprising:

a neck portion;

a suspension element extending upwardly from the neck portion;

a top arm molded to the underside of the neck portion;

a bottom arm for holding a garment molded to one end of the top arm and connectable to a second end of the top arm; and a connecting element consisting of a protrusion molded to and extending perpendicularly from the second end of the top arm, and a hole positioned on the bottom arm for receiving and securing the protrusion, whereby the bottom arm is connected to the second end of the top arm by pushing the protrusion through the hole.

2. The garment hanger of claim 1, wherein the protrusion is formed from two symmetrical half portions.

3. The garment hanger of claim 2, wherein the two symmetrical half portions each include a top portion and a base portion, the top portion having a larger diameter than the base portion.

4. The garment hanger of claim 2, wherein the two symmetrical half portions are angled apart from each other.

5. The garment hanger of claim 1, wherein the hanger is made from bendable plastic.

6. The garment hanger of claim 1, wherein the neck portion has an area of at least 0.5 inches squared.

7. The garment hanger of claim 1, wherein the top and bottom arms are between 4 and 10 inches long.

* * * * *